United States Patent [19]

Jayne

[11] Patent Number: 4,791,898

[45] Date of Patent: Dec. 20, 1988

[54] V-ENGINE WITH YOKE

[75] Inventor: Michael E. Jayne, Belchertown, Mass.

[73] Assignee: R P & M Engines, Inc., Amherst, Mass.

[21] Appl. No.: 937,021

[22] Filed: Dec. 2, 1986

[51] Int. Cl.[4] ..... F02B 75/32

[52] U.S. Cl. ..... 123/197 AC; 123/55 R

[58] Field of Search ..... 123/197 R, 197 A, 197 AB, 123/197 AC, 53 A, 56 R, 56 A, 56 AC, 56 B, 56 C, 56 BC, 55 VF, 55 R

[56] References Cited

U.S. PATENT DOCUMENTS

| | | | |
|---|---|---|---|
| 1,349,660 | 8/1920 | Buhl | 123/197 AC |
| 1,498,757 | 6/1924 | Robertson | 123/53 A |
| 2,101,556 | 12/1937 | Morgan | 123/56 AC |
| 2,229,545 | 1/1941 | Beckstrom | 123/56 C |
| 4,449,494 | 5/1984 | Beaudoin | 123/197 AC |
| 4,584,972 | 4/1986 | Jayne et al. | 123/197 AC |

*Primary Examiner*—Charles J. Myhre
*Assistant Examiner*—David A. Okonsky
*Attorney, Agent, or Firm*—Walter W. Burns, Jr.

[57] ABSTRACT

A V-engine is provided with a scotch yoke and connecting rods attaching plural pistons to the yoke such that the power stroke of both pistons is substantially simultaneous and the return strokes are substantially silmultaneous. Piston dwell is introduced by virtue of the lateral and angular displacement of the pistons in their respective angularly disposed cylinders and, in addition, dwell is introduced by virtue of the scotch yoke configuration wherein the slot retaining a sliding block connecting the yoke to the throw of a crankshaft may be of various configurations, rectilinear, curvilinear and offset arcuate in configuration.

16 Claims, 2 Drawing Sheets

V-ENGINE WITH YOKE

The invention relates to V-engines employing a scotch yoke and is applicable to engines in general, for example external combustion engines and internal combustion engines which may be diesel or gasoline powered, two stroke cycle or four stroke cycle, the invention being directed to increasing the dwell of pistons at either top dead center or bottom dead center of a crankshaft, or both.

PRIOR ART

U.S. Pat. No. 4,584,972 to Jayne et al, issued Apr. 29, 1986 shows an engine employing a scotch yoke having a curvilinear slot with a sliding block received for motion within the slot for transmitting motion to a crank throw of a crankshaft wherein dwell is introduced to the piston by virtue of the configuration and disposition of the curvilinear slot within the yoke.

U.S. Pat. No. 4,598,672 to Jayne et al, issued Jul. 8, 1986, shows a scotch yoke engine having a rectilinear slot within the yoke with means for transmitting pressure to one side of the yoke to maintain the yoke against an opposing side of a crankcase.

The complexities in design of V-engines as known in the prior art is such that the implementation of scotch yoke technology such as that set forth in the above patents without modification results in substantial increased costs, both as to design, manufacture and maintenance.

Further, no satisfactory provision is mad in the prior art for retrofit of connecting rod engines with scotch yokes appropriate for increasing piston dwell.

OBJECTS OF THE INVENTION

Accordingly, it is an object of the invention to overcome the difficulties in the prior art by providing a V-engine employing a scotch yoke wherein a connecting rod is connected to each of two pistons for rotation with respect thereto, each piston being in a cylinder, the two cylinders being configured as a V with opposite end of each connecting rod connected for rotation with respect to a scotch yoke received for linear movement within a crankcase, the scotch yoke having a slot within which is received a sliding block which may transmit movement to a crank throw, the latter being connected to a crankshaft mounted within the crankcase of the engine.

It is another object of the invention to provide a scotch yoke for a V-engine configured to increase piston dwell at at least one of top dead center and bottom dead center of the crankshaft within a crankcase.

It is another object of the invention to provide a V-engine with a scotch yoke wherein the engine designer may tailor the design of a crankcase to specific power requirements without significant modification of the cylinder block and attendant structure.

It is another object of the invention to provide a scotch yoke for a V-engine which may be employed to retrofit an existing V-engine previously equipped with connecting rods but without a yoke wherein the retrofit is effected with a minimum change in hardware and minimal expense in the retrofitting.

It is another object of the invention to provide a retrofit for diesel locomotive engines previously provided with connecting rods wherein the retrofit provides a scotch yoke configured to increase piston dwell and to improve the dynamic compression ratio for the engine.

It is another object of the invention to provide a scotch yoke for V-engines for augmenting dynamic compression on a power stroke of the engine and for augmenting scavenging during a return stroke.

It is another object of the invention to provide an engine having a crankshaft disposed within a crankcase and comprising at least two cylinder means, each cylinder means having an axis, said axes each being orthogonally disposed with respect to an axis of said crankshaft and angularly disposed with respect to each other to define a plane, a master yoke assembly means engaging opposite sides of said crankcase mounted for movement orthogonally with respect to the axis of the crankshaft and in a direction in said plane lying between said axes, a piston means disposed within each of said cylinder means for movement along said axis of said cylinder means, first means connecting each of said piston means to the master yoke assembly means for movement of said piston means relative to the master yoke assembly, and second means connecting the master yoke assembly means to the crankshaft for movement of said crankshaft relative to said master yoke assembly means.

It is another object of the invention to provide an engine such as that described wherein the direction of movement of the master yoke assembly means is along a line which makes equal angles with respect to each axis of each cylinder.

It is another object of the invention to provide a scotch yoke for a V-engine wherein a piston is connected by a first bearing means engaging the Piston means to a connecting rod mounted to the first bearing means for movement relative thereto and a second bearing means engages said connecting rod for movement relative thereto and engages a master scotch yoke assembly means for movement relative thereto.

It is another object of the invention to provide a scotch yoke for a V-engine wherein a master yoke assembly means comprises a slot and a sliding block means connects a crank throw of a crankshaft of the engine for movement with respect to the crank throw, the sliding block means being disposed within a slot of the master yoke assembly means for movement with respect thereto.

It is another object of the invention to provide a V-engine employing a master yoke assembly means comprising a substantially rectilinear slot means disposed substantially orthogonally with respect to the direction of movement of the master yoke assembly means.

It is another object of the invention to provide a scotch yoke for a V-engine wherein a master yoke assembly means comprises an arcuate slot means having a center radius of curvature disposed remote from pistons with respect to a crankshaft.

It is another object of the invention to provide a scotch yoke for a V-engine wherein a master yoke assembly means comprises an arcuate slot having a center radius of curvature disposed offset with respect to a center line delineating the direction of motion of the master yoke assembly means.

It is another object of the invention to provide a V-engine having a crankshaft with a crankshaft axis and at least plural cylinders disposed in a plane orthogonal to the crankshaft axis, each cylinder having a cylinder axis, the cylinder axes of said cylinders intersecting at a point to form an angle, and a yoke received within a crankcase for movement along an axis lying in the plane and within the angle formed by the said cylinder axes, the yoke having a slot therewithin and a sliding block means disposed within the slot for movement therewithin to transmit motion between the yoke and a crank throw mounted on said crankshaft, and means connected to each of said pistons for rotation with respect to each of said pistons and connected to said yoke for rotation with respect to said yoke.

It is another object of the invention to provide a scotch yoke for a V-engine wherein axes of plural cylinders are disposed orthogonally with respect to a crankshaft axis and the axes of the cylinders intersect at a point which is remote from the pistons with respect to the axis of the crankshaft for increasing the dwell of the pistons in the vicinity of top dead center of the crankshaft.

It is another object of the invention to provide a scotch yoke for a V-engine having a crankshaft and plural cylinders disposed angularly with respect to each other and orthogonal to the crankshaft axis of the engine, the axes of the cylinders intersecting at a point and wherein the axis of the crankshaft is remote from the pistons with respect to said point for increasing the dwell of the pistons in the vicinity of bottom dead center of the crankshaft.

It is another object of the invention to provide a scotch yoke for a V-engine, the yoke having a curvilinear slot disposed for effecting movement of a sliding block which transmits, by way of a crank throw, motion to a crankshaft and wherein a center of curvature of the curvilinear slot means is disposed for increasing piston dwell at top dead center of the crankshaft.

It is another object of the invention to provide a scotch yoke for a V-engine wherein means is provided for engaging one side of the yoke to apply a force to the yoke in a direction lying in a plane orthogonal to the crankshaft axis to increase the pressure of the yoke against an opposing side of the crankcase.

The foregoing and other objects and advantages of the invention will be apparent to those skilled in the art from a consideration of the drawings wherein plural embodiments of the invention are disclosed and wherein;

FIG. 1 discloses a scotch yoke with arcuate soot having a center of curvature symmetric to the configuration of a V-engine having plural pistons and cylinders;

DETAILED DESCRIPTION OF THE INVENTION

Figure 1:
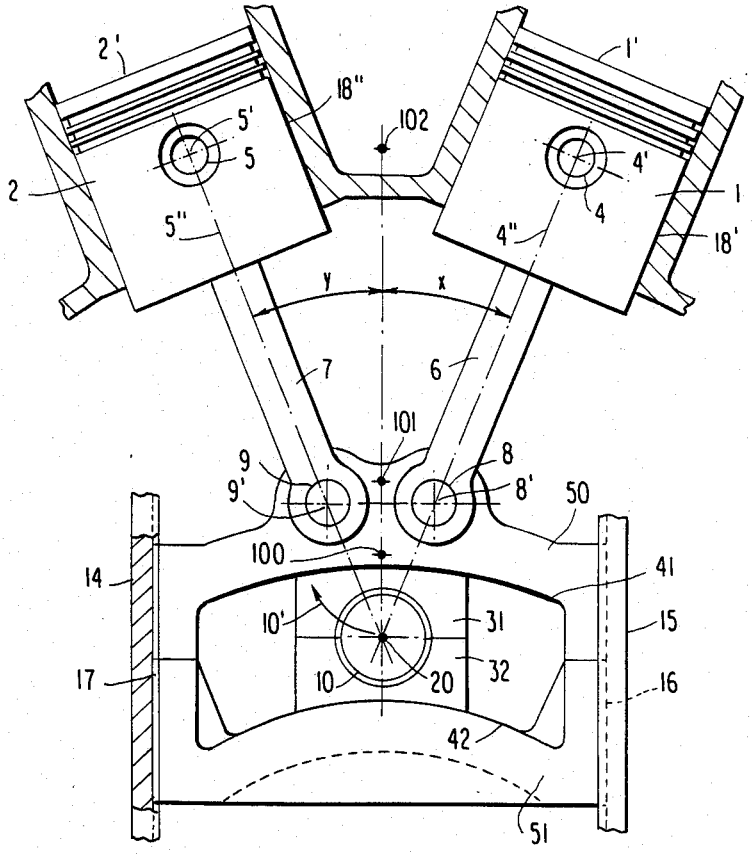

Turning now to a consideration of the figures wherein like reference numerals represent like elements, FIG. 1 shows a V-engine comprised of two cylinders 18′ and 18″ with pistons 1 and 2 respectively mounted therein. A wrist pin 4 with an axis 4′ is mounted in piston 1, the wrist pin 4 being connected to a connecting rod 6, the other end of which is mounted to a master yoke assembly comprised of two parts 50 and 51. The connecting rod 6 is connected to the part 50 by a wrist pin 8 having an axis 8′.

A wrist pin 5 having an axis 5′ is mounted within piston 2, the wrist pin 5 being connected to one end of connecting rod 7. The opposite end of the connecting rod 7 is connected to a wrist pin 9 having an axis 9′, the wrist pin 9 being connected to the part 50 of the master yoke assembly.

An arcuate slot having surfaces 41 and 42 is disposed within the master yoke assembly 50, 51 with a sliding block composed of elements 31 and 32 slidably engaging the surfaces 41 and 42. Within the sliding block a crank throw 10 is mounted having an axis 20. The sides of the master yoke assembly 50, 51, carry V-guides which engage in V-channels in opposing sides of crankcase 14 and 15, the base of the V-guides within the crankcase sides being indicated at 16 and 17 respectively.

As shown in FIG. 1, the master yoke assembly 50 and 51 is at bottom dead center with the axis 20 representing a point of intersection of the respective axes of the cylinders 18′ and 18″, such that the axes 5′ and 9′ of the wrist pins 5 and 9 are in line with the point of intersection 20. Similarly, the axes 4′ and 8 are in line with the point of intersection 20.

The axis of the crankshaft is shown at 100, directly above the point 20 of intersection. Thus, the axis 4″ of the cylinder 18′ is seen to make an angle x with the line between the point of intersection 20 and the axis 100 of the crankshaft. Similarly, the axis 5″ makes an angle y with a line drawn through the point of intersection 20 and the axis 101 of the crankshaft.

It will be seen from the foregoing as the crank throw 10 proceeds in a clockwise direction about the crankshaft axis 100 as shown by the arrow 10′. The master yoke assembly 50, 51, will move upwardly carrying with it the wrist pins 8 and 9, the connecting rods 6 and 7 and, in turn, the pistons 1 and 2 which proceed outwardly along their respective axes 4″ and 5″.

In like manner, after top dead center is reached by the crank throw 10 at a point 101 above crankshaft axis 100, if a force is applied simultaneously to the surfaces 1′ and 2′ of pistons 1 and 2, FIG. 1, as for example by ignition of a fuel input to the corresponding combustion chamber for cylinders 18′ and 18″, the pistons 1 and 2 will proceed toward the bottom dead center.

Figure 2:
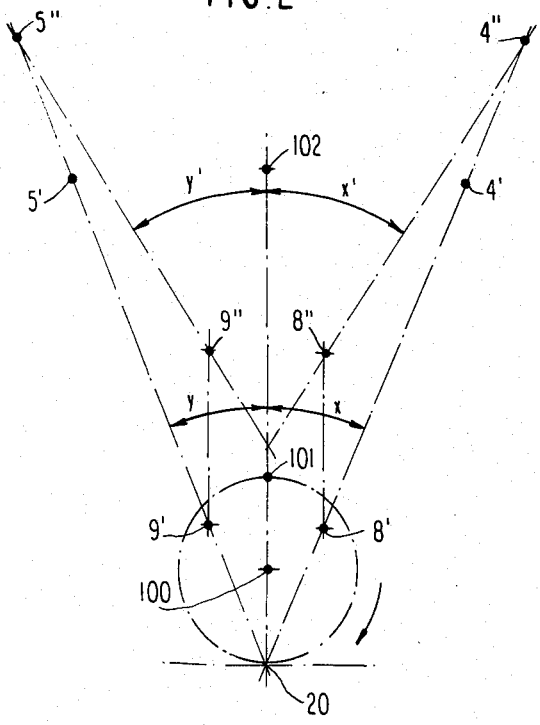
FIG. 2 shows a schematic diagram of a configuration of the invention providing piston dwell at top dead center.

The changes in position of the master yoke assembly 50, 51, wrist pins 8 and 9, connecting rods 6 and 7, wrist pins 4 and 5 and pistons 1 and 2, as the master yoke assembly 50, 51 moves from bottom dead center to top dead center may be understood from a consideration of FIG. 2. As the crank throw 20 proceeds in clockwise motion about crankshaft axis 100, to top dead center 101, the axes of the wrist pins 8 and 9 move vertically to positions 8″ and 9″ with the connecting rods 6 and 7 moving the axes of wrist pins 4 and 5 to points 4″ and 5″. In so doing, it will be appreciated that the angular position of the connecting rods 6 and 7 change so that the connecting rods make an angle with the line 20-102 indicated by angles x′ and y′, x′ being greater than x and y′ being greater than y.

Upon the return stroke from top dead center 101 to bottom dead center 20 the connecting rods 6 and 7 assume the positions shown respectively by 8' and 4'and 9' and 5'.

While the invention implemented as described in connection with FIGS. 1 and 2 has angles substantially equal to angle y, the invention may also be implemented with angle x not equal to the angle y.

It will be appreciated that, as configured in FIG. 2, the point of intersection, at 20 of the line 20-9'-5'-5" and the line 20-8'-4'-4" is below the axis 100 of the crankshaft. With this relationship in mind, it will be apparent that passage of the axis of the throw 10 through top dead center at 101 results in a dwell of the pistons 1 and 2 at the points 4" and 5", by virtue of the fact that the positions of the pistons 1 and 2 are laterally displaced with respect to the center line passing through the yoke, that is, the line 20-100-101-102. Put another way, movement of the piston 1 along its corresponding cylinder axis, in the vicinity of top dead center 101 is less than the corresponding movement of the master yoke assembly 50, 51 vertically along the line 20-102. The same relationship obtains with regard to movement of the piston 2 along the axis of its cylinder such that for a corresponding incremental movement of the piston 2 in the vicinity of top dead center is less than the corresponding vertical displacement of the master yoke assembly 50, 51 along the line 20-101.

It will be seen therefore from the foregoing that by virtue of the lateral and angular displacement of the axes of the cylinders for the pistons 1 and 2, respectively from the line 20-102, dwell has been introduced to the movement pistons 1 and 2.

Further, it will be observed that such dwell has been introduced independently of dwell which may be introduced as a result of uses of any particular configuration of the slot 41, 42, in the master yoke assembly 50, 51. The dwell has been introduced by the V-configuration of the axes of the cylinders for pistons 1 and 2 and the movement of the connecting rods 6 and 7 with their respective wrist pins 4, 8 and 5, 9, and the fact that the engine shown in FIG. 1 is configured with the point of intersection of the axes of the cylinders for pistons 1 and 2 configured to be below the axis 101 of the crankshaft at bottom dead center.

The point of intersection, 20, as shown in FIGS. 1 and 2, may assume other positions without departing frm the spirit of the invention. The point 20 of intersection may be off the line 100-102, in cases, for example, where angle x does not equal angle y.

Figure 3:
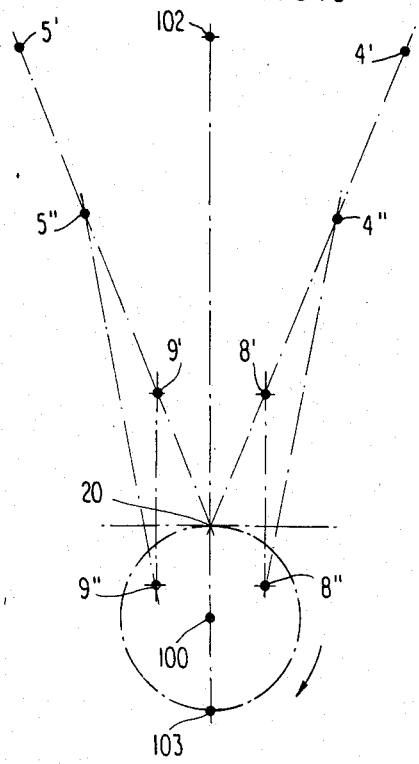
FIG. 3 shows a schematic diagram of the invention providing piston dwell at bottom dead center of the crankshaft.

As shown in FIG. 3, if it is desired to introduce a dwell at bottom dead center, the position of the axes of the cylinders for pistons 1 and 2 may be configured such that the point of intersection 20 of such axes is above the axis 100 of the crankshaft at top dead center, shown at 20 in FIG. 3. The clockwise excursion of the crank throw 10 toward bottom dead center at 103, as shown by the arrow will cause the wrist pins 8 and 9 to remove their respective axes 8' and 9' to points 8" and 9", downwardly, carrying the connecting rods 6 and 7 to new positions. For the connecting rod 6, the new position of the wrist pin axes is 4"-8" and for the connecting rod 7, the new position is 5"-9".

As with FIG. 2, the lateral and angular displacement of the cylinder axes for pistons 1 and 2 away from the vertical line 103-102 determines that as the crank throw 10 passes bottom dead center, dwell will be introduced to the pistons 1 and 2 in their return stroke toward points 4' and 5'.

With regard to FIGS. 1, 2 and 3, it is appropriate to make the following observations. Two pistons 1 and 2 are connected to a single master yoke assembly 50, 51 and the axes of the cylinders for the pistons 1 and 2 make equal angles with the center plane of the engine indicated by the line 20–102. As shown, an exemplary value for the respective angles from the central plane is 22.5 degrees. It will be appreciated by those skilled in the art that other angles may be employed.

Figure 6:
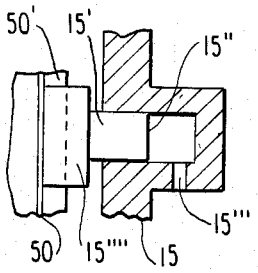
FIG. 6 shows a partial view of the device of FIG. 1 modified to show lateral application of a force to the yoke to stabilize the yoke within the crankcase.

The master yoke assembly 50, 51 may be stabilized within the crankcase as to movement departing from its direction of movement introduced by connecting rods 6 and 7 by means such as that disclosed in FIGS. 18–22 in Jayne et al U.S. Pat. No. 4,598,672. FIG. 6 shows an embodiment wherein element 50 of the master yoke assembly has a V-guide 50' engaging a matching V-guide 15"' of a member 15' which is mounted in crankcase 15. A port 15"' admits a liquid or fluid from a source, not shown, which applies a force to surface 15". The force from member 15' serves to force the master yoke assembly 50, 51 toward an opposing V-guide, not shown, mounted in the opposite side of the crankcase.

The movement of the pistons 1 and 2 along their respective cylinder axes is made up of two components; first, movement determined by the action of the sliding block 31, 32 within the slot 41, 42 and secondly a movement correlated to the angular disposition of the cylinder axes for the pistons 1 and 2 from the center line 20–102.

Because the master yoke assembly 50, 51 moves vertically parallel to the line 20–102, which line makes angles x and y of equal magnitude with the axes of the cylinders for pistons 1 and 2, no difference in extent of piston motion between the two cylinders exists, that is to say, for any given angular movement of the crank throw about the crankshaft axis 100, pistons 1 and 2 will make corresponding movements along their axes, the movements being equal to each other in the configuration shown. Concomitantly, the connecting rods 6 and 7 have exactly the same amount of lateral displacement as their respective pistons 1 and 2, also due to the equal angles x and y.

It is contemplated, within the scope of the invention, that the two wrist pins 8 and 9 mounted to the master yoke assembly 50, 51, may be disposed asymmetrically with respect to the line 20–102 of FIGS. 1, 2 and 3. Under such circumstances the pistons may have a different amount of lateral displacement of their respective connecting rods 6 and 7 from the center line of the cylinders 18' and 18". Under these circumstances, the pistons 1 and 2 will have rates of motion which differ with respect to each other and with respect to the rate of motion of the crank position.

From the standpoint of practical applications, the utilization of a master yoke assembly for two pistons on one crank rod journal, as for example shown in FIGS. 1–3 is important for diesel engines for the reason that it enables the practioner to use a smaller combustion chamber for an individual piston on each master yoke assembly instead of that which would be required for a single piston operating with a master yoke assembly. Use of two smaller combustion chambers, one for each of the two cylinders for the single master yoke assembly, instead of one larger combustion chamber for a single piston for a master yoke assembly makes it possible to increase the crankshaft rpm and thus the power output of the diesel engine inasmuch as diesel engine speed is greatly affected by combustion chamber size.

This derives from the fact that the time lapse for completing the movement of a flame front throughout the combustion chamber of a large single piston must necessarily be greater than the time lapse necessary for the flame front to complete a traverse of a small cylinder combustion chamber. The result is that for the same displacement per master yoke assembly as would be used for a single piston with single combustion chamber, distribution of that displacement between two cylinders, as in FIGS. 1–4, makes it possible to increase the diesel engine rpm.

The engine designer may control the amount of dwell by the configuration and disposition of the wrist pins and the point of intersection. As previously explained, if the intersecting point is below the crankshaft axis, then the piston dwell is achieved at top dead center. This characteristic is beneficial in creating a dynamic compression ratio on the power stroke of engines such as four stroke cycle engine with valves set in the cylinder head. Similarly, if the intersecting point is above the crankshaft axis, the piston dwell may be introduced at bottom dead center. This is useful in increasing the effectiveness of scavenging in engines having side port valves such as two stroke cycle engines.

With the intersecting point 20 coincident with the crankshaft axis 100, piston dwell at top dead center due to lateral movement of the connecting rods 6 and 7 is substantially equal to dwell at bottom dead center.

Thus, the magnitude of piston dwell existing at the top dead center and bottom dead center, respectively, is a function of the lateral displacement of the connecting rods.

The dwell due to lateral and angular displacement of cylinders 18' and 18" and the connecting rods 6 and 7 is in addition to the dwell introduced by the configuration and disposition of the slot 31, 32 in the master yoke assembly 50, 51.

An advantage of using a master yoke assembly such as that shown at 50 and 51 which has connecting rods 6 and 7 connected to two pistons 1 and 2 is that it enables manufacturers of V-type engines to retrofit the configuration of the invention to existing engines which may previously have had conventional piston-connecting rod-crank throw structures, the retrofit requiring no major overhaul of cylinder block, cylinder head, crankshaft and attendant structures. The retrofitted engine with the additional dwell introduced by the presence of the scotch yoke and by the presence of the lateral and angular displacement of the cylinders, as described above, will result in a favorable dynamic compression ration for four stoke cycle engines, for example, and where improved scavenging in two stroke cycle engines is desired, the invention will improve the scavenging characteristics after retrofit.

It will be seen from the foregoing that the capability to retain a major number of original parts of the engine, after retrofit according to the invention, is of paramount importance in cost-effectiveness.

The stabilization of the master yoke assembly 50, 51 within the crankcase as shown in FIG. 6 is of particular importance for large diesel power units such as are used in locomotives. In warming up to operating temperature, such engines can be expected to generate significant expansion in the master yoke assembly. Such expansion can be accommodated without causing binding on the bearing surfaces of the side guides 16 and 17 of FIG. 1 of the instant disclosure if one or more of the guides is pressurized from an oil system, the guide so pressurized having the capability of relative movement with regard to the crankcase of the engine so that as expansion occurs, the guide retracts against the side of the crankcase. A discussion of this method of accommodating yoke expansion is to be found in the U.S. Pat. No. 4,598,672 to Jayne et al.

Figure 4:
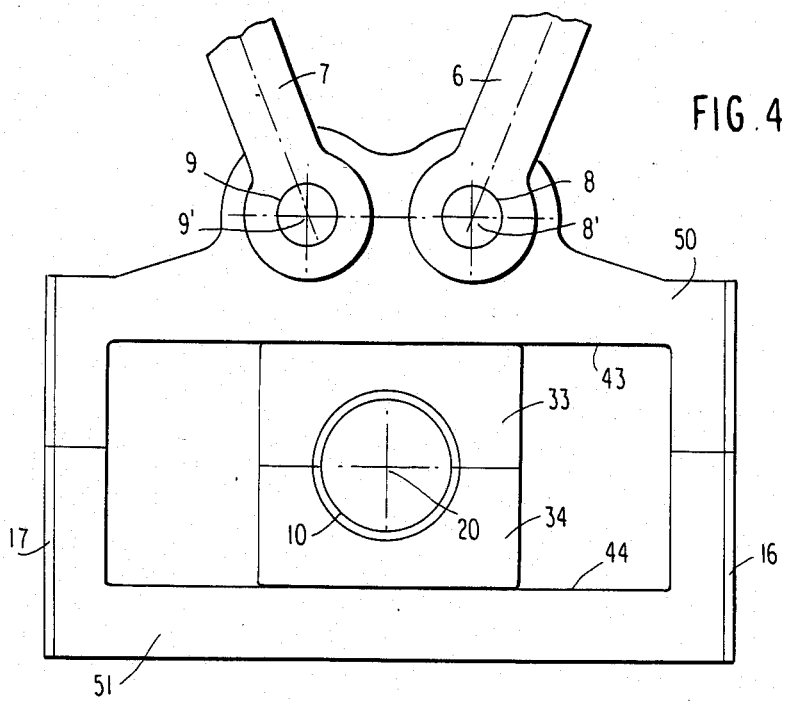
FIG. 4 shows a section embodiment of the invention wherein a scotch yoke has a rectilinear slot.

FIG. 4 of the instant disclosure shows a configuration according to the invention wherein the yoke has a rectilinear slot 43, 44, retaining the sliding block 33, 34, affording excursions of the crank throw 10 through the extent of the slot 43, 44. The apparatus of FIG. 4 is otherwise generally similar to that shown in FIG. 1. A discussion of the dwell afforded by the rectilinear slot is to be found in the patent to Jayne et al, U.S. Pat. No. 4,598,672 referred to above.

The dwell afforded by the rectilinear slot scotch yoke may thus be considered to add to the effect of the dwell afforded by the lateral angular disposition of the cylinders 18' and 18", together pistons 1 and 2 with attendant connecting rods 6 and 7 connected at wrist pins 8 and 9 to the master yoke assembly 50, 51.

Figure 5:
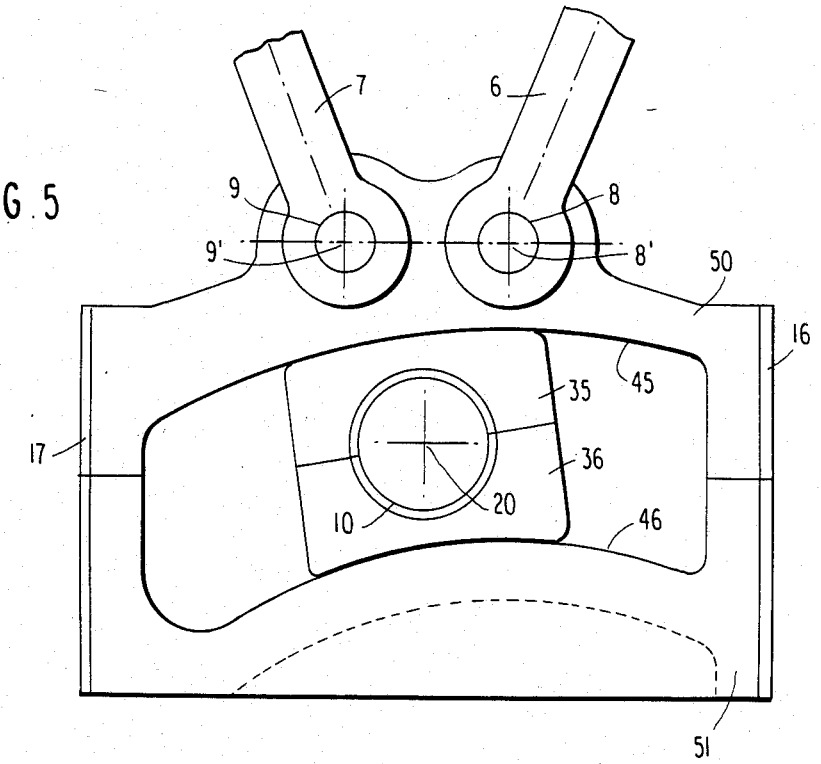
FIG. 5 shows another embodiment of the invention wherein a scotch yoke has an arcuate slot with an offset center of curvature.

In like manner, FIG. 5 shows a master yoke assembly 50, 51 with an arcuate slot 45, 46 retaining the sliding block 35 and 36 which is connected to the crank throw 10 having an axis 20. The arcuate slot 45, 46 has an offset center of curvature providing a dynamic compression ratio as described in the U.S. Pat. No. 4,584,972 to Jayne et al. The invention according to FIG. 5 is otherwise similar to the disclosure in FIG. 1 with the angularly displaced cylinder axes of cylinders 18' and 18", pistons 1 and 2, connecting rods 6 and 7 and wrist pins 8 and 9, the master yoke assembly 50, 51 being retained within the crankcase by slides 16 and 17.

As with the disclosure of FIG. 4, the piston dwell introduced by the offset arcuate slot as described in the reference to patent is independent of and in addition to the dwell introduced by the lateral angular displacement of the cylinders 18' and 18" or pistons 1 and 2 and the connecting rods 6 and 7 as explained in connection with FIG. 1.

A single assembly of one master yoke assembly 50, 51 has been shown connected to pistons 1 and 2 in two angles 18' and 18' of a V configuration, it is however contemplated within the scope of the invention to employ multiple such assemblies in alignment along a single crankshaft.

While I have shown and described plural embodiments in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. An engine having a crankshaft disposed within a crankcase and comprising;

at least a pair of cylinder means, each cylinder means having an axis;

said axes each being orthogonally disposed with respect to an axis of said crankshaft, the axes of said pair of cylinder means being angularly disposed in V configuration with respect to each other substantially to define a plane;

a master yoke assembly means engaging opposite sides of said crankcase mounted for movement orthogonal with respect to the axis of the crankshaft and in a direction in said plane and lying between said axes;

a piston means disposed within each of said cylinder means for movement along said axis of said cylinder means;

first means connecting each of said piston means to the master yoke assembly means for movement of said piston means relative to the master yoke assembly means; and second means connecting the master yoke assembly means to the crankshaft for movement of said crankshaft relative to said master yoke assembly means.

2. An engine in accordance with claim 1, wherein the direction of movement of the master yoke assembly means is long a line which makes substantially equal angles with respect to each axis of each cylinder.

3. An engine in accordance with claim 1, wherein the first means comprises;

a first bearing means mounted to said piston means;

a second bearing means mounted to said master yoke assembly means; and a connecting rod rotatably connected to each of said first bearing means and second bearing means for movement relative thereto.

4. An engine in accordance with claim 1, wherein the master yoke assembly means comprises a slot, and the second means comprises sliding block means connected to a crank throw of said crankshaft for movement with respect to the crank throw, the sliding block means being disposed within the slot to engage the master yoke assembly means for movement with respect thereto.

5. An engine in accordance with claim 1, wherein the master yoke assembly means comprises;

a substantially rectilinear slot means disposed substantially orthogonally with respect to the direction of movement of the master yoke assembly means.

6. An engine in accordance with claim 1, wherein the master yoke assembly means comprises an arcuate slot means having a center of radius of curvature disposed remote from said piston means with respect to said crankshaft.

7. An engine in accordance with claim 2, wherein the master yoke assembly means comprises an arcuate slot means having a center of a radius of curvature disposed substantially on said line.

8. An engine in accordance with claim 2, wherein the master yoke assembly means comprises an arcuate slot means having a center of a radius of curvature disposed offset with respect to said line.

9. A V-engine having a crankshaft with a crankshaft axis and at least plural cylinders disposed substantially in a plane orthogonal to the crankshaft axis, each cylinder having a cylinder axis, the cylinder axes of said cylinders substantially intersecting at a point to form a V angle and defining a plane, and a yoke received within a crankcase for movement along an axis lying in the plane and within the V angle formed by the said cylinder axes, the yoke having a slot therewithin and a sliding block means disposed within the slot for movement therewithin to transmit motion between the yoke and a crank throw mounted on said crankshaft;

the engine further comprising means connected to each of said pistons for rotation with respect to each of said pistons and connected to said yoke for rotation with respect to said yoke.

10. An engine according to claim 9, wherein the said point is remote from the pistons with respect to the axis of the crankshaft for increasing the dwell of the pistons in the vicinity of top dead center of the crankshaft.

11. An engine according to claim 9, wherein the said axis of the crankshaft is remote from the pistons with respect to the said point for increasing the dwell of the pistons in the vicinity of bottom dead center of the crankshaft.

12. An engine according to claim 9, wherein the yoke comprises a rectilinear slot means disposed for effecting movement of the sliding block orthogonally with respect to the direction of movement of the yoke.

13. An engine according to claim 9, wherein the yoke comprises a curvilinear slot means disposed for effecting movement of the sliding block along an arc having a center of curvature disposed for increasing piston dwell at top dead center of the crankshaft.

14. An engine according to claim 13, wherein the center of curvature lies outside of a plane containing the point and the axis of the crankshaft.

15. An engine according to claim 9, further comprising means engaging one side of the yoke to apply a force to the yoke in a direction lying in a plane orthogonal to the crankshaft axis to increase the pressure of the yoke against an opposing side of the crankcase.

16. In a V-engine having at least a pair of cylinders, each cylinder of said pair having a cylinder axis, the said cylinder axes of said pair being angularly disposed with respect to each other substantially intersecting to define a plane, a piston in each cylinder, a connecting rod for each piston and having first and second ends, the first end being rotatably connected to said each piston, a crankcase with a crankshaft therein, the crankshaft having at least one crankthrow, and a sliding block rotatably mounted to said at least one crankthrow, the improvement comprising a yoke, means for slidably mounting the yoke to said crankcase, means for slidably coupling the yoke to the sliding block, and means for rotatably coupling th yoke to said two connecting rods.

* * * * *